United States Patent [19]

Takahashi

[11] Patent Number: 4,486,015

[45] Date of Patent: Dec. 4, 1984

[54] SHEET DIVERTING DEVICE FOR COPYING APPARATUS OR THE LIKE

[75] Inventor: Yuji Takahashi, Naka, Japan

[73] Assignee: Canon Kabushiki Kaisha, Tokyo, Japan

[21] Appl. No.: 374,028

[22] Filed: May 3, 1982

[30] Foreign Application Priority Data

Jun. 9, 1981 [JP] Japan ..... 56-88614

[51] Int. Cl.[3] ..... B65H 29/60

[52] U.S. Cl. ..... 271/305

[58] Field of Search ..... 271/297, 303, 305

[56] References Cited

U.S. PATENT DOCUMENTS

| | | | |
|---|---|---|---|
| 3,343,672 | 9/1967 | De Vries | 271/305 X |
| 3,411,771 | 11/1968 | Bahr . | |
| 3,420,368 | 1/1969 | Rosenberg | 271/305 X |
| 3,750,880 | 8/1973 | Petrovsky | 271/305 X |
| 4,146,215 | 3/1979 | Mol | 271/303 X |
| 4,319,745 | 3/1982 | Pinard | 271/305 |

*Primary Examiner*—Richard A. Schacher

*Attorney, Agent, or Firm*—Fitzpatrick, Cella, Harper & Scinto

[57] ABSTRACT

A sheet diverting device in a copying apparatus or the like for diverting sheets from a first transportation path has at least second, third and fourth transportation paths diverging from the first transportation path, first deflector displaceable to a first position for guiding a sheet from the first transportation path to the second transportation path and a second position for blocking the passage of the sheet from the first transportation path to the second transportation path and constituting a part of a path for guiding the sheet to the third transportation path, and second deflector displaceable to a first position for guiding the sheet from the first transportation path to the fourth transportation path and a second position for blocking the passage of the sheet from the first transportation path to the fourth transportation path and constituting another part of the path for guiding the sheet to the third transportation path.

2 Claims, 7 Drawing Figures

SHEET DIVERTING DEVICE FOR COPYING APPARATUS OR THE LIKE

BACKGROUND OF THE INVENTION

1. Field of the Invention

This invention relates to a sheet diverting device in a copying apparatus, a printing apparatus, a recording apparatus or other machine including an apparatus handling the transportation of sheets (hereinafter referred to as the copying apparatus or the like), and more particularly to a sheet diverting device for diverting sheets from a single path into three other paths.

2. Description of the Prior Art

As a device of this type, there is one in which when sheets are to be successively transported to one of the bin groups, for example, of a sorter or the like which effects classification of the sheets, the sheets are selectively directed by diverging a single sheet transportation path into two discrete paths. However, if the device becomes complicated, there may occur cases where the sheets must be diverted in various directions in accordance with the usage or function of the device, for example, in the copying apparatus or the like, the sheets must be transported in the one-side direction or in the both-side direction or in the sorter direction. In such cases, if a plurality of diverting devices are provided, it will be possible to provide a plurality of diverging paths correspondingly thereto. However, the provision of a plurality of diverting devices is very inconvenient in terms of the space for arranging them and also involves the complexity such as the necessity of changing over and controlling them discretely.

SUMMARY OF THE INVENTION

In view of the above-noted disadvantages, the present invention intends to provide an improved novel sheet diverting device.

It is another object of the present invention to provide a sheet diverting device which is capable of diverging sheets from a single sheet transportation path into any of at least three other paths.

That is, the construction of the present invention which can achieve the above objects consists in a sheet diverting device for transporting sheets from a first transportation path, which device has at least three (i.e. second, third and fourth) transportation paths diverging from the first transportation path, first deflecting means displaceable to a first position for guiding a sheet from the first transportation path to the second transportation path and a second position for blocking the passage of the sheet from the first transportation path to the second transportation path and constituting a part of a path for guiding the sheet to the third transportation path, and second deflecting means displaceable to a first position for guiding the sheet from the first transportation path to the fourth transportation path and a second position for blocking the passage of the sheet from the first transportation path to the fourth transportation path and constituting another part of the path for guiding the sheet to the third transportation path.

Thus, according to the construction of the present invention, sheets can be deflected from a single sheet transportation path into at least three sheet transportation paths, and the transportation of sheets to a number of functional positions can be achieved by a simple construction.

The invention will become more fully apparent from the following detailed description thereof taken in conjunction with the accompanying drawings.

DESCRIPTION OF THE PREFERRED EMBODIMENTS

Figure 1:
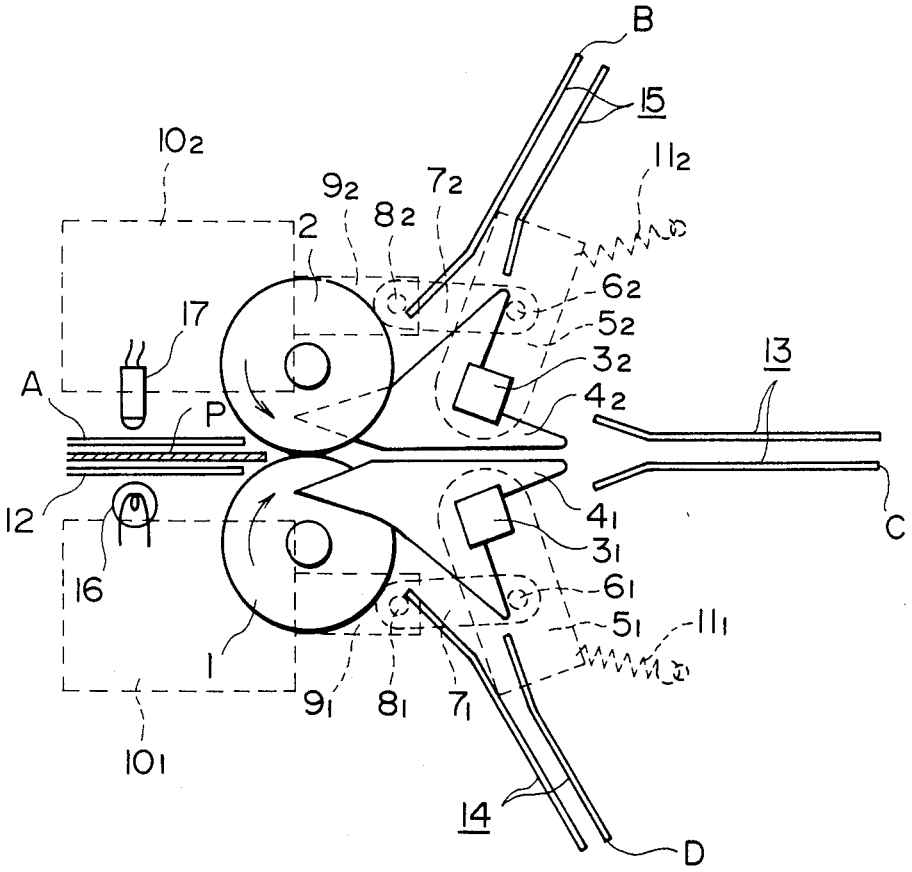
FIG. 1 is a cross-sectional view of an embodiment of the present invention.
Figure 2:
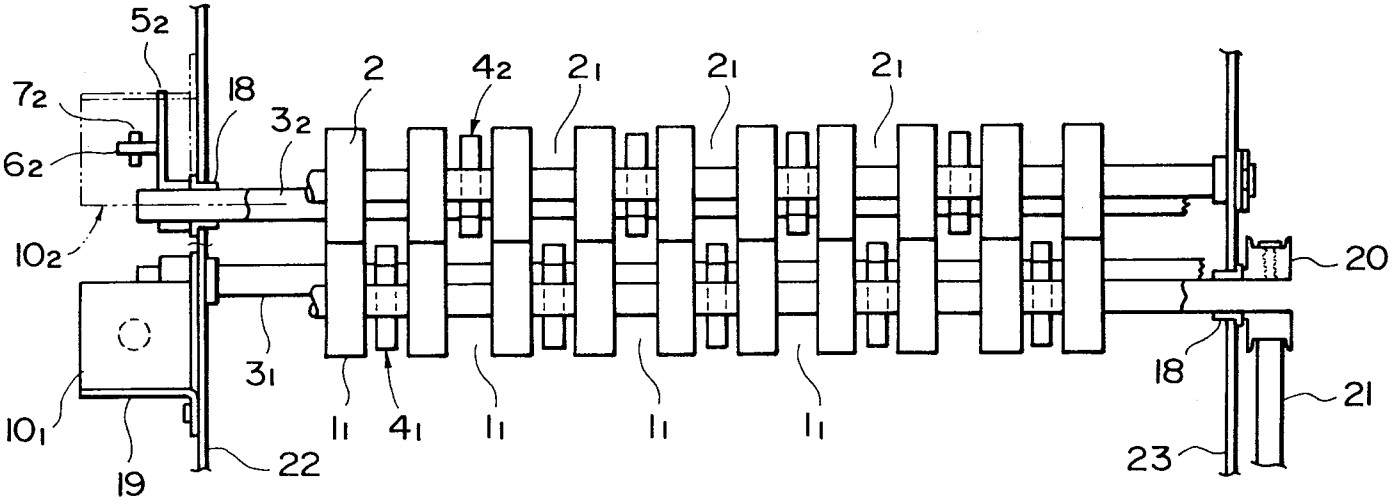
FIG. 2 is a side view corresponding to FIG. 2.

A specific embodiment of the present invention will hereinafter be described in detail by reference to the drawings. FIG. 1 is a cross-sectional view of the embodiment, and FIG. 2 is a side view corresponding to FIG. 1. In these figures, a drive roller 1 for transporting sheets has a plurality of grooves $\mathbf{1}_1$ in the thrust directions and is supported between a left side plate 22 and a right side plate 23 by means of bearings 18, and a drive pulley 20 is mounted on the right end of the drive roller. A belt 21 is wound on the drive pulley 20, which is rotated clockwisely by unshown drive means, as shown in FIG. 1. A keep roller 2 is urged against the drive roller 1 from gravity, and the keep roller 2 is also provided with a plurality of grooves $\mathbf{2}_1$ similar to those of the drive roller 1, and deflector means $\mathbf{4}_1$ and $\mathbf{4}_2$ are provided in the grooves of the upper and lower rollers. The deflectors $\mathbf{4}_1$ and $\mathbf{4}_2$ are mounted on support shafts $\mathbf{3}_1$ and $\mathbf{3}_2$, respectively, and are alternately disposed between the grooves of the drive roller 1 and the keep roller 2 to prevent interference between the deflectors $\mathbf{4}_1$ and $\mathbf{4}_2$. The support shafts $\mathbf{3}_1$ and $\mathbf{3}_2$ are rotatably supported between the left and right side plates 22 and 23 by means of bearings 18, and drive arms $\mathbf{5}_1$ and $\mathbf{5}_2$ are pivotally mounted on the left ends of the support shafts. Pins $\mathbf{6}_1$ and $\mathbf{6}_2$ are caulked on the drive arms $\mathbf{5}_1$ and $\mathbf{5}_2$, respectively, and links $\mathbf{7}_1$ and $\mathbf{7}_2$ are engaged with pins $\mathbf{8}_1$ and $\mathbf{8}_2$ provided on the plungers $\mathbf{9}_1$ and $\mathbf{9}_2$ of solenoids $\mathbf{10}_1$ and $\mathbf{10}_2$, so that the operating forces of the solenoids $\mathbf{10}_1$ and $\mathbf{10}_2$ are transmitted to the drive arms $\mathbf{5}_1$ and $\mathbf{5}_2$ to move the deflectors $\mathbf{4}_1$ and $\mathbf{4}_2$. Springs $\mathbf{11}_1$ and $\mathbf{11}_2$ are extended between one end of the drive arms $\mathbf{5}_1$ and $\mathbf{5}_2$ and a rear side plate so that when the solenoids $\mathbf{10}_1$ and $\mathbf{10}_2$ are not energized, the deflectors $\mathbf{4}_1$ and $\mathbf{4}_2$ are positioned between the grooves of the drive roller 1 and the keep roller 2, as shown. The solenoids $\mathbf{10}_1$ and $\mathbf{10}_2$ are mounted on the rear side plate by means of brackets 19.

A sheet P is transported between guide plates 12 and to the drive roller 1. A light-emitting lamp 16 and a light-receiving sensor 17 are mounted on the guide plates 12 so that light passes through holes formed in the guide plates 12 to detect the retardation of the sheet and examine the presence of jam. Simultaneously therewith, the sensor detects the leading end edge of the sheet and produces a signal for changing over the diverting direction. That is, when the sheet intercepts the sensor portion 16, 17, there is produced a timing for determining which of the solenoids $\mathbf{10}_1$ and $\mathbf{10}_2$ in the diverting direction should be energized. Now, in FIG. 1, both the solenoids $\mathbf{10}_1$ and $\mathbf{10}_2$ are in non-energized condition and the sheet transported from the direction A is guided by the straight portions of the deflectors $\mathbf{4}_1$ and $\mathbf{4}_2$ and is transported in the direction C (third transportation path) while passing between guide plates 13 (the condition in which both of the deflectors $4_1$ and $4_2$ have been displaced to a second position; see FIG. 1).

Figure 3:
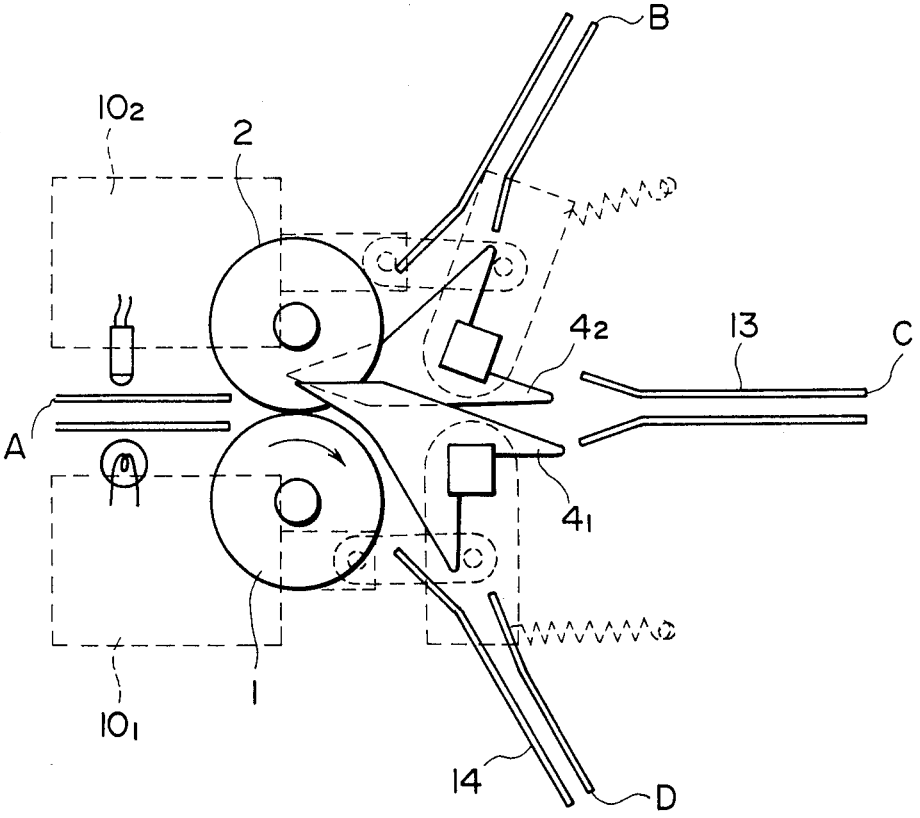
FIGS. 3 and 4 are cross-sectional views showing the diverting operation condition.

FIG. 3 shows the condition in which the solenoid $10_1$ is energized and the solenoid $10_2$ is not energized. The left end portion of the deflector $4_1$ comes into the groove $2_1$ of the roller 2, and the drive roller 1 and the inclined portion of the deflector $4_1$ together constitute a transportation path and therefor, the sheet transported from the direction A is transported rightwardly downwardly while being guide by the inclined portion of the deflector $4_1$ and is conveyed in the direction D (a fourth transportation path) through guide plates 14 (the condition in which the deflector $4_1$ has been displaced to a first position and the deflector $4_2$ has been displaced to a second position; see FIG. 3).

Figure 4:
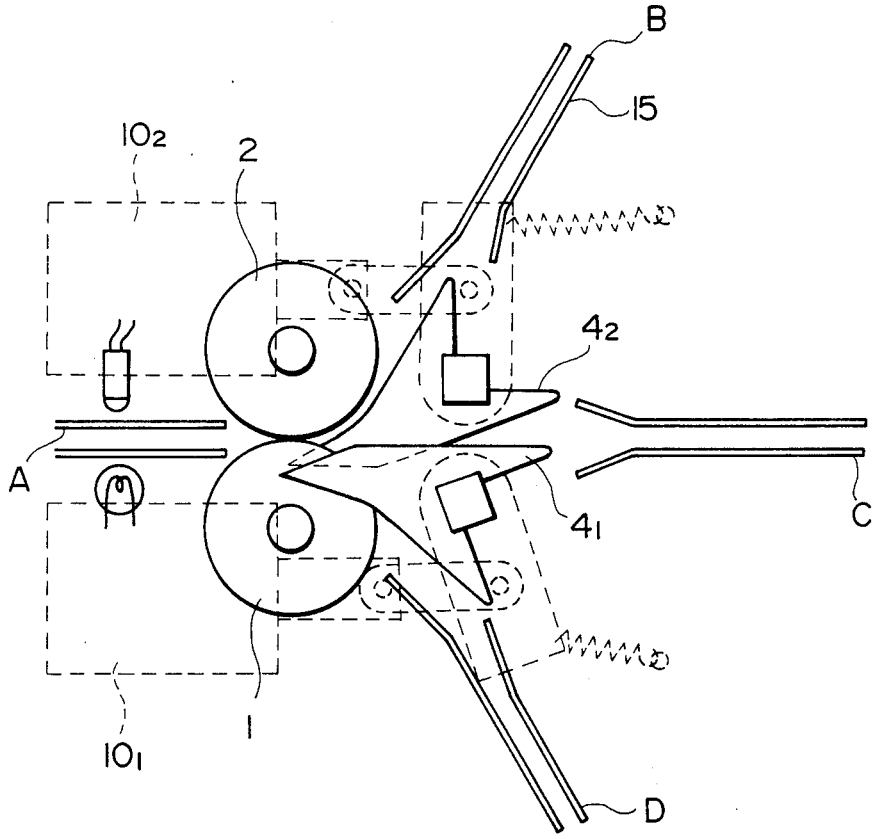

FIG. 4 shows the condition in which the solenoid $10_1$ is not energized and the solenoid $10_2$ is energized. The left end portion of the deflector $4_2$ comes into the groove $1_1$ of the drive roller 1 and the keep roller 2 and the inclined portion of the deflector $4_2$ together constitute a transportation path and therefore, the sheet transported from the direction A is transported rightwardly upwardly while being guided by the inclined portion of the deflector $4_2$ and is conveyed in the direction B (a second transportation path) through guide plates 15 (the condition in which the deflector $4_1$ has been displaced to the second position and the deflector $4_2$ has been displaced to the second position; see FIG. 4).

As is apparent from the example of FIGS. 1, 3 and 4, the diverting direction is determined by the energization or deenergization of the solenoids $10_1$ and $10_2$, but energizing both solenoids $10_1$ and $10_2$ at a time is inhibited. The above-described relations will be shown in the table below.

| Solenoid $10_1$ | Solenoid $10_2$ | Diverting direction | Remarks |
|---|---|---|---|
| OFF | OFF | direction C | |
| ON | OFF | direction D | |
| OFF | ON | direction B | |
| ON | ON | | this combination is inhibited. |

Figure 5:
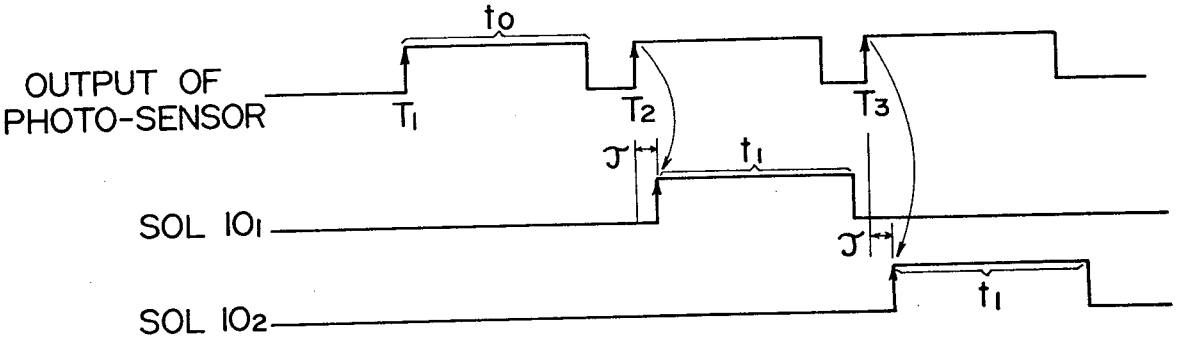
FIG. 5 is a timing chart.

FIG. 5 shows the epitome of the timing chart. In FIG. 1, assume that three sheets are transported from the direction A and diverted in the directions C, D and B, respectively. The level of the output of the photosensor rises from L to H at timings $T_1$, $T_2$ and $T_3$, and the output of the photosensor is maintained at H for the passage time $t_0$ of the sheets. The first sheet is transported in the direction C and therefore, both of the solenoids $10_1$ and $10_2$ remain non-energized. The next sheet is diverted in the direction D and therefore, the solenoid $10_1$ alone is energized in the delay time $\tau$ after the timing $T_2$. The energization holding time $t_1$ may be suitably determined in the relation that $t_0 < t_1$ by the size of the sheets. The last sheet is diverted in the direction B and therefore, the solenoid $10_2$ alone is energized for a time $t_1$ in the delay time $\tau$ after the timing $T_3$.

In the present embodiment, the sheets are shown to be transported in the direction C during the non-energization of the solenoids $10_1$ and $10_2$, whereas this is not restrictive but if the mounted position of the solenoids and how the drive arm should be moved during the energization of the solenoids are determined, the diverting direction during the non-energization of both solenoids can be arbitrarily determined to the direction B or D.

The mechanism for causing the sheets to divert from a single path into any of three directions has been described above, but if the transportation direction of sheets is reversed, the present invention may also be used as a mechanism for causing sheets transported from three directions to gather in a single direction.

That is, when, in FIG. 1, the driving direction of the drive roller is counter-clockwise direction and sheets are transported from the directions B, C and D, the solenoids $10_1$ and $10_2$ are controlled in accordance with the transportation directions, whereby the sheets can be transported in the direction A.

Also, by controlling the rotational direction of the drive roller and the solenoids which drive the deflectors, a sheet transported, for example, from the direction B is fed in the direction A, whereafter the sheet is transported in the reverse direction and the drive roller is rotated clockwisely and the solenoid $10_1$ is energized while the solenoid $10_2$ is deenergized, whereby the sheet can be transported in the direction D.

Figure 6:
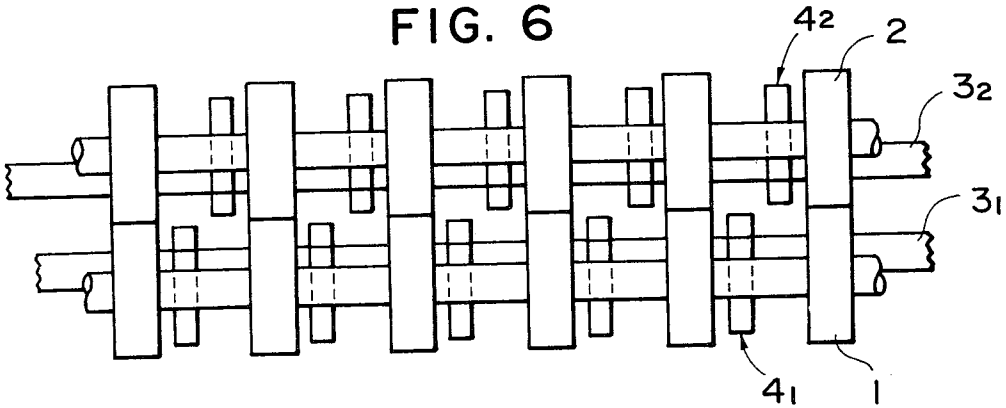
FIGS. 6 and 7 are side views showing further embodiments of the present invention.
Figure 7:
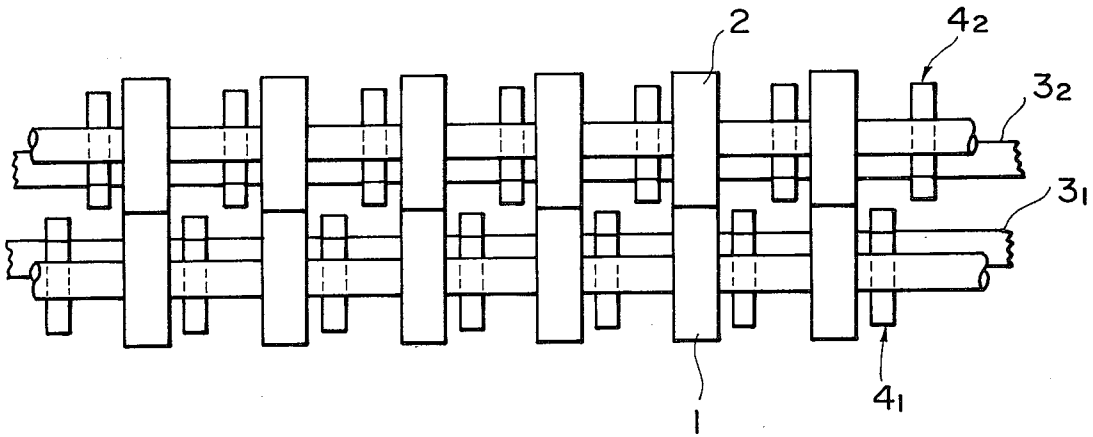

Also, as an embodiment of the present invention, there has been shown in FIG. 2 an example in which deflectors are alternately disposed in the grooves of the drive roller 1 and the keep roller 2, whereas this is not restrictive but, as shown, for example, in FIG. 6, two deflectors may be disposed in each groove of the drive roller 1 and the keep roller 2 in a positional relation in which the two deflectors do not interfere with each other, whereby the arrangement density of the deflectors can be improved. It is also possible to disposed deflectors not only in the grooves of the drive roller 1 and the keep roller 2 but also on the end portios of the shafts, as shown in FIG. 7.

I claim:

1. A sheet diverting device for a copying apparatus or the like for diverting sheets from a first transportation path, said device having at least second, third and fourth transportation paths diverging from said first transportation path, first deflecting means displaceable between a first position for guiding a sheet from said first transportation path to said second transportation path and a second position for blocking the passage of the sheet from said first transportation path to said second transportation path and constituting a part of a path for guiding the sheet to said third transportation path, second deflecting means displaceable between a first position for guiding the sheet from said first transportation path to said fourth transportation path and a second position for blocking the passage of the sheet from said first transportation path to said fourth transportation path and constituting another part of the path for guiding the sheet to said third transportation path, and a pair of rollers for transporting the sheet provided near the diverging portion of said first, second, third and fourth transportation paths, the sheet guiding fore end portions of said first and second deflecting means being disposed at the nip between said pair of rollers.

2. A sheet diverting device according to claim 1, wherein said pair of rollers are provided with a plurality of grooves, and said first and second deflecting means are alternately disposed in said grooves.

* * * * *